US005148223A

United States Patent [19]

Cipolla

[11] Patent Number: 5,148,223

[45] Date of Patent: Sep. 15, 1992

[54] DEVELOPER DISPENSER HAVING A DEVELOPER MOVER FOR TRANSPORTING DEVELOPER

[75] Inventor: Stephen D. Cipolla, Penfield, N.Y.

[73] Assignee: Xerox Corporation, Stamford, Conn.

[21] Appl. No.: 614,263

[22] Filed: Nov. 16, 1990

[51] Int. Cl.[5] ..... G03G 15/06

[52] U.S. Cl. ..... 355/260; 118/653; 222/DIG. 1

[58] Field of Search ..... 355/245, 260, 259, 215; 118/653, 656; 222/DIG. 1

[56] References Cited

U.S. PATENT DOCUMENTS

| | | | |
|---|---|---|---|
| 4,353,637 | 10/1982 | Parker | 355/260 |
| 4,417,802 | 11/1983 | Forbes, II | 355/260 |
| 4,647,180 | 3/1987 | Watanabe et al. | 355/260 |
| 4,743,937 | 5/1988 | Martin | 355/259 |
| 4,766,457 | 8/1988 | Barker et al. | 355/260 |
| 4,903,634 | 2/1990 | Ono et al. | 118/653 |
| 4,920,381 | 4/1990 | Mahoney | 355/260 |

FOREIGN PATENT DOCUMENTS

| | | | |
|---|---|---|---|
| 0089078 | 4/1987 | Japan | 355/260 |
| 0210867 | 9/1988 | Japan | 355/260 |
| 0032381 | 2/1990 | Japan | 355/260 |
| 0043580 | 2/1990 | Japan | 355/260 |

*Primary Examiner*—A. T. Grimley
*Assistant Examiner*—William J. Royer
*Attorney, Agent, or Firm*—Kenyon & Kenyon

[57] ABSTRACT

A developer dispenser is disclosed that has a substantially enclosed rigid housing with a side wall and a pair of end walls, an opening in the side wall, and a flexible developer mover disposed within the housing. The developer mover has one edge pivotably secured to the side wall, a second edge in sliding contact with the side wall, one surface facing the side wall and the other surface facing the opening and engaging the developer in the housing. The developer mover bends flexibly about an axis parallel to the side wall to move the surface facing the side wall toward the wall and away from the opening. When developer is contained in the housing between the developer mover and opening, the weight of the developer deflects the developer mover away from the opening. In turn, the developer mover resiliently urges the developer toward the opening.

12 Claims, 4 Drawing Sheets

DEVELOPER DISPENSER HAVING A DEVELOPER MOVER FOR TRANSPORTING DEVELOPER

BACKGROUND OF THE INVENTION

In a commonly-used electrostatographic reproducing apparatus, a photoconductive insulating member is typically charged to a uniform potential and exposed to a light image of an original document to be reproduced. The exposure discharges the photoconductive insulating surface in exposed or background areas and creates an electrostatic latent image on the member that corresponds to the image areas contained within the original document. The latent image is made visible by developing the image with developing material.

Most development systems employ a developer having both charged carrier particles and charged toner particles that triboelectrically adhere to the carrier particles. During development the toner particles are attracted from the carrier particles by the charge pattern of the latent image on the photoconductive insulating member to form a powder image on the member. Alternatively, single component development systems can be employed that use only toner particles. The developed image can be transferred to a support surface such as copy paper to which it can be permanently affixed by heat or pressure.

In most commercial applications the particulate developer is contained in a sump from which it is dispensed by gravity feeding. Such an arrangement inherently has a vertical dimension that is unsuitably large for a compact automatic printer. Further, functional units of the reproducing apparatus such as the imaging member, developer housing, cleaner housing, and charge corotron can be combined within a removable processing cartridge that is discarded when the developer is exhausted, the photoreceptor is worn out, or the cleaning sump is full. A desirable configuration for such a cartridge includes a generally horizontal developer sump and developer housing rather than the typical vertical, gravity feed sump and housing.

A horizontal cartridge configuration requires a mechanism to transport developer from the sump portion to the developer portion. This is particularly important in systems that require a constant supply of developer to a nip between a developer donor roll and a charge metering roll to provide an adequate quantity of charged developer to the imaging member during development.

One mechanism that has been used to transport developer is a paddle wheel that rotates through the developer and pushes it toward the rolls. However, such systems have been found to be inefficient in that they typically cannot transport all of the developer in the sump portion, so that some residual amount of developer is wasted.

Another mechanism employs a flexible sheet-like sump liner to move the developer. The liner is conformable to the longitudinal walls of the developer sump, has one end anchored to the wall near the opening in the sump through which the developer is dispensed, and has its other end attached to a roller mechanism. When the sump is full of developer, the liner conforms to the perimeter of the longitudinal walls between the roller and the anchor point. As the developer is used, the liner is taken up on the roller and pulls away from the sump walls, contracting the volume enclosed within the liner and urging the developer toward the sump opening.

Such liner systems are disclosed in U.S. Pat. Nos. 4,766,457 to Barker, et al. and 4,647,180 to Watanabe. Such systems are inherently more mechanically complex than simple gravity feed systems because they require at least a liner, a roller, and some mechanism for winding the film onto the roller. Such additional parts increase the cost of the developer system and the possibility of mechanical failure and decrease the volume of the sump housing available for developer.

There is therefore a need to provide a mechanically simpler, less expensive, and lower volume mechanism to transport developer horizontally and efficiently in a developer system.

SUMMARY OF THE INVENTION

The invention described herein overcomes deficiencies described in connection with prior art devices described above. A feature of the invention is the simplicity of the mechanism employed to enhance dispensing of developer for its desired use, such as in a photocopying operation. For this purpose a developer dispenser is used that has a substantially enclosed and rigid housing with a side wall having an opening therein, two end walls, and a flexible developer mover disposed within the housing. The developer mover has one edge pivotably secured within said housing, a second edge in sliding contact with a portion of the side wall, one surface facing that portion of the side wall, and a second surface engaging the developer material. The developer mover divides the housing into a first, developer reservoir region bounded by the first surface and the side wall and being in fluid communication with the opening and a second region bounded by the first surface and the side wall. The developer mover assumes a first, unflexed position when the housing contains no developer and flexes about an axis parallel to the side wall to displace the first surface to a second position when the housing is filled with developer in which the first surface conforms approximately to the first portion of the side wall. In this second position, the second region has a volume much less that when the developer mover is in said first position. The developer mover urges the developer toward the opening, and flexes toward the first position as developer is dispensed through the opening. This provides a simple, low volume, and low-cost mechanism for transporting the developer material.

The above discussion is a summary of certain deficiencies in the prior art and features of the invention described herein. Other features and advantages of the invention will be apparent to those skilled in the art from the following detailed description of the invention.

DETAILED DESCRIPTION

Figure 1:
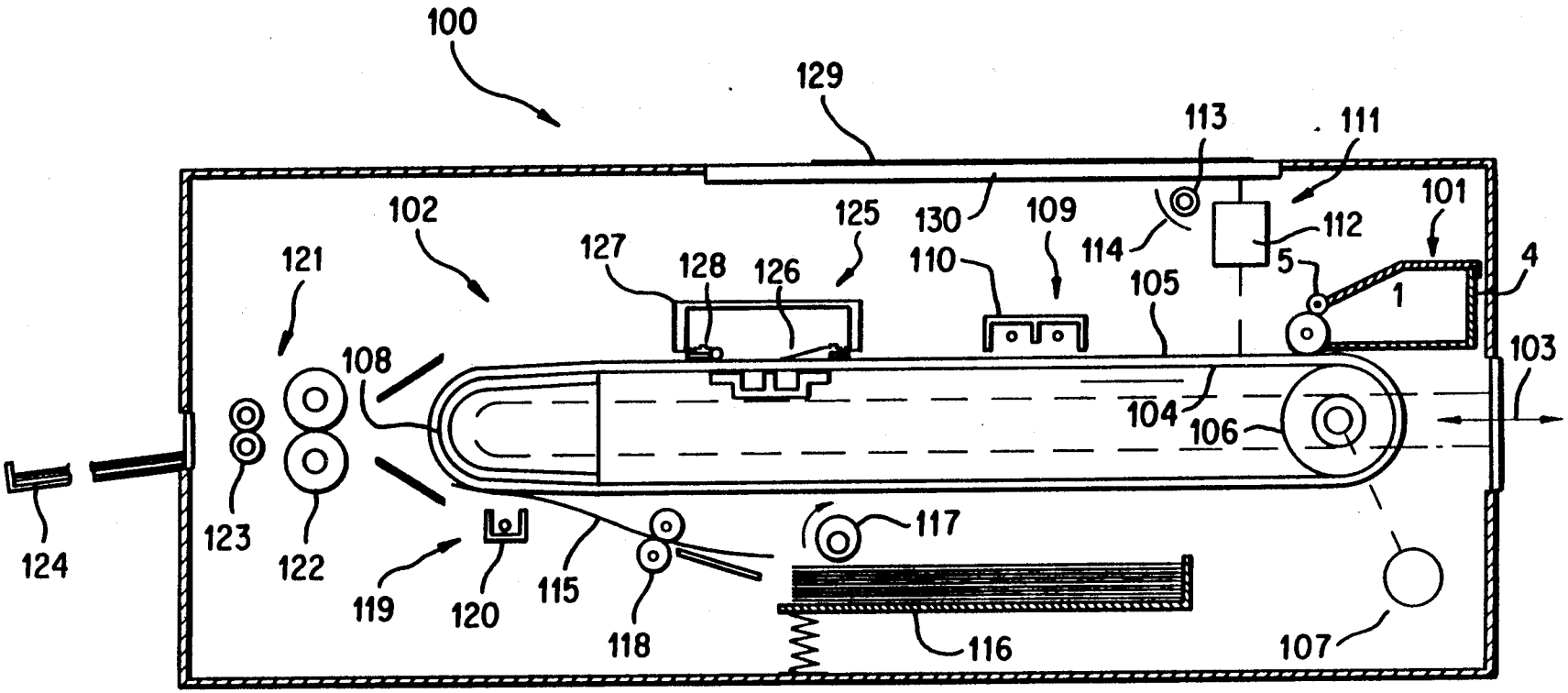
FIG. 1 is a schematic representation in cross section of an automatic electrostatographic printing machine with a developer housing constructed according to the principles of the invention.

An automatic electrostatographic reproducing machine 100 is illustrated in FIG. 1. The reproducing machine includes a removable processing cartridge employing the developer apparatus according to the invention. The reproducing machine shown in FIG. 1 illustrates the components used to produce copies from an original document. Although the apparatus of the invention is particularly well adapted for use in automatic electrostatographic reproducing machines, it should be evident from the following description that it is equally well suited for use in a wide variety of processing systems including printers and is not necessarily limited to the particular illustrated embodiment.

The reproducing machine 100 illustrated in FIG. 1 employs a removable processing cartridge 102, which may be inserted and withdrawn from the main machine frame in the direction of arrow 103. Cartridge 102 includes an image recording photoreceptor belt 104, the outer surface of which is coated with a suitable photoconductive material 105. The belt is mounted for revolution within the cartridge about driven transport roll 106, around belt tracking shoe 108, and travels in the direction indicated by the arrow on the inner run of the belt to bring the image-bearing surface of the belt past the plurality of xerographic processing stations. Suitable drive means such as motor 107 power and coordinate the motion of the various components.

Charging station 109 charges the belt uniformly with an electrostatic charge by placing the charge on the photoconductive surface with charge corotron 110 in a known manner. Exposure station 111 exposes the photoconductive surface 105 to the light image of the original input scene information. In this process, the charge is selectively dissipated in the light exposed regions to record the original input scene in the form of an electrostatic latent image. In the illustrated embodiment, the exposure station comprises a bundle of image transmitting fiber lenses 112, an illuminating lamp 113, and a reflector 114. Horizontal transport viewing platen 130 supports an original document 129 image side down and transports the original past the exposure station. The speeds of the moving platen and photoconductive belt are synchronized to provide accurate reproduction of the original.

Developer station 101 applies developer to the photoconductive surface of the belt to render the latent image visible. In the illustrated embodiment, shown in FIG. 1, the developer station includes donor roll 1, a developer particle supply reservoir 3, and a metering charging roll 5, contained within developer housing 4, as described in greater detail below.

As shown in FIG. 1, sheets 115 of the final support material are supported in a stacked arrangement on elevated stack support tray 116. With the stack at its elevated position, the sheet separator segmented feed rolls 117 feed individual sheets from the stack to the registration pinch roll pair 118. The pinch roll pair feeds the sheets to the transfer station 119. The transfer station comprises a transfer corotron 120 that transfers the toner image from the photoreceptor belt 104 to the sheet. Fixing station 121 comprises roll fuser 122 which fixes a transferred toner image to the sheet. Output rolls 123 advance finished sheets to sheet stacking tray 124.

Residual toner remaining on the photoreceptor belt 104 is removed at cleaning station 125. In the illustrated embodiment, the cleaning station comprises a cleaning housing 127 containing a cleaning blade 126 in scraping contact with the outer periphery of the belt and a cleaning seal 128 placed at the upstream opening of the cleaning housing.

The invention will be described in conjunction with the developer station illustrated in detail in FIGS. 2–5. The developer station has a compliant donor roll 1 that transports weakly charged insulating non-magnetic developer particles into contact with the electrostatic latent image recorded on the photoconductive surface of photoreceptor belt 104. Donor roll 1 rotates in the direction of the arrow and in a direction opposite to that of the photoreceptor belt 104. A developer particle supply reservoir 3 contained within developer housing 4 furnishes developer particles to the donor roll 1. A metering charging roll 5, which rotates in the direction shown by the arrow, contacts donor roll 1 to form nip 6 between the two rolls.

Weakly charged developer particles on donor roll 1 pass through nip 6 and between the two rolls as the rolls rotate, and acquire an electrostatic charge. These charged developer particles are then transported by the donor roll to the electrostatic latent image recorded on photoreceptor belt 104. The electrostatic latent image attracts the toner particles from donor roll 1 to form a toner image on the surface of photoreceptor belt 104.

The rigid developer housing 4 has a side wall, which in the illustrated embodiment comprises three longitudinal walls: lower wall 10, vertical wall 11, and upper wall 12. The free end of doctor blade 13, mounted on upper wall 12, contacts the metering charging roll 5 to act as a seal to prevent developer particles from advancing beyond the blade. Flap seal 15, mounted on lower wall 10, sealingly engages the surface of donor roll 1. A dispensing opening 14, through which developer is dispensed from developer housing 4, is defined by the space between doctor blade 13 and flap seal 15.

Figure 2:
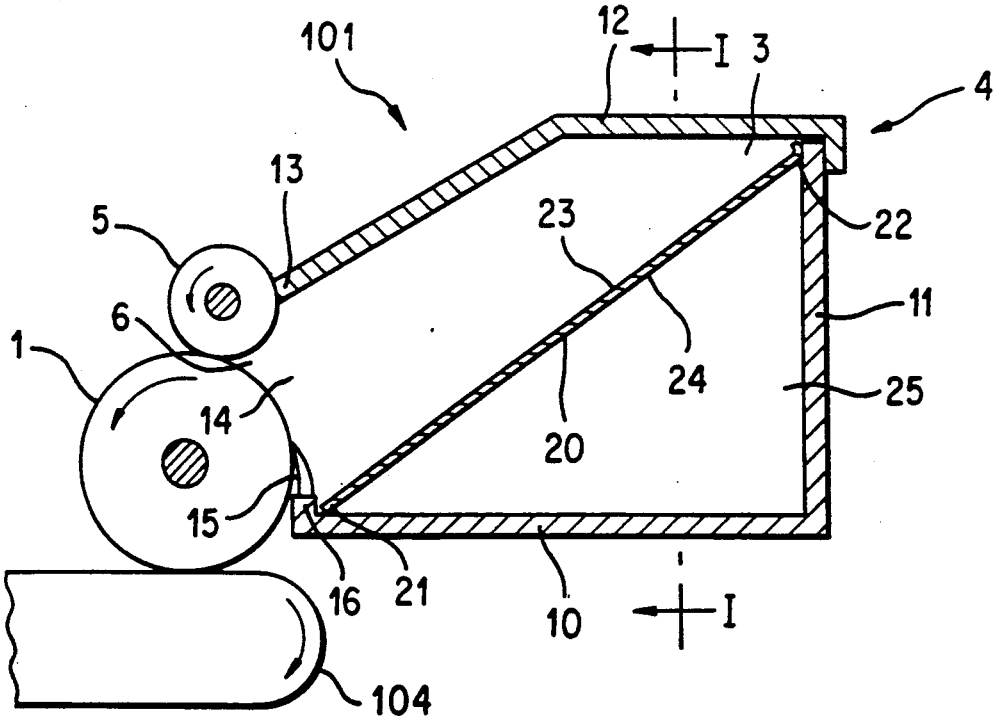
FIG. 2 is a schematic representation in cross section of the developer housing constructed according to the principles of the invention with an empty developer sump.

As shown in FIG. 2, a flexible developer mover 20 is mounted inside developer housing 4. The developer mover abuts at edge 21 against shoulder 16 of lower wall 10 so as to be pivotably secured. The mover has a first surface 24 generally facing the side wall portion and a second surface 23 generally facing the opening and engaging the developer. The opposite edge 22 of the developer mover slidably engages the inner surface of vertical wall 11 and terminates in an arcuate portion curving about an axis parallel to the side wall and toward the first surface. Developer mover 20 can be made of any suitable flexible material such as metal or plastic. In the illustrated embodiment, the developer mover is formed of stainless spring steel. The developer mover is approximately 12" in length in the plane of FIG. 2, and has a thickness of between 0.003" and 0.0045", producing an aspect ratio (length to thickness) of between 4,000 and 2,667. The developer mover can be coated on the second surface with poly(ethylene terephthalate) sold under the trademark MYLAR ®, a registered trademark of the E.I. DuPont de Nemours and Company, Wilmington, Del., to protect the developer from contamination by the steel.

Figure 3:
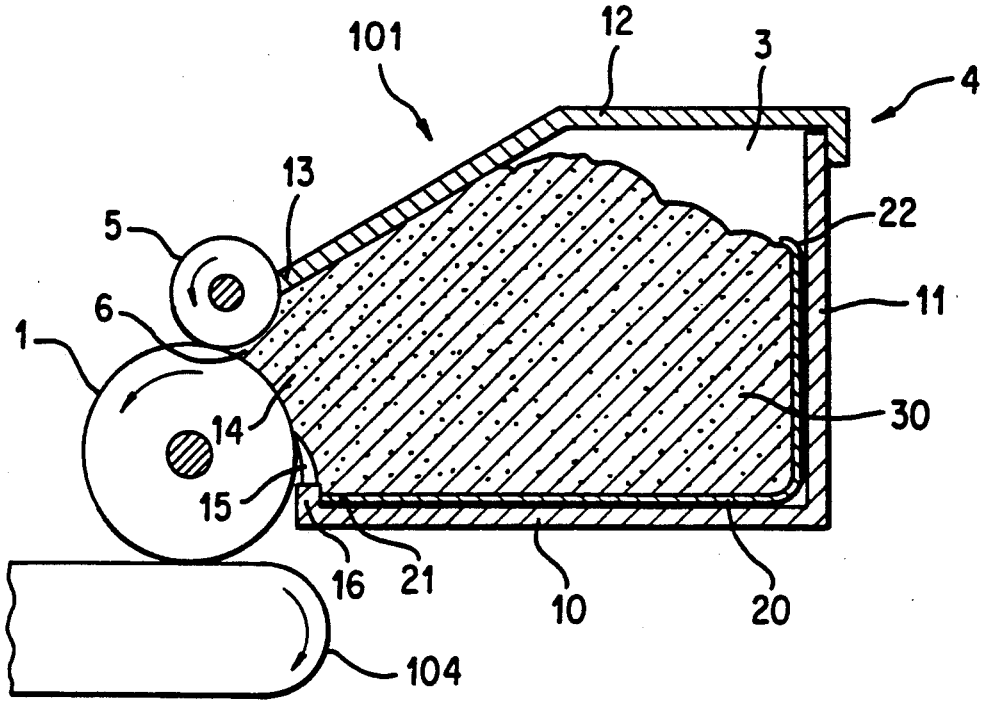
FIG. 3 is a schematic representation in cross section of the developer housing shown in FIG. 2 with a full developer sump.
Figure 4:
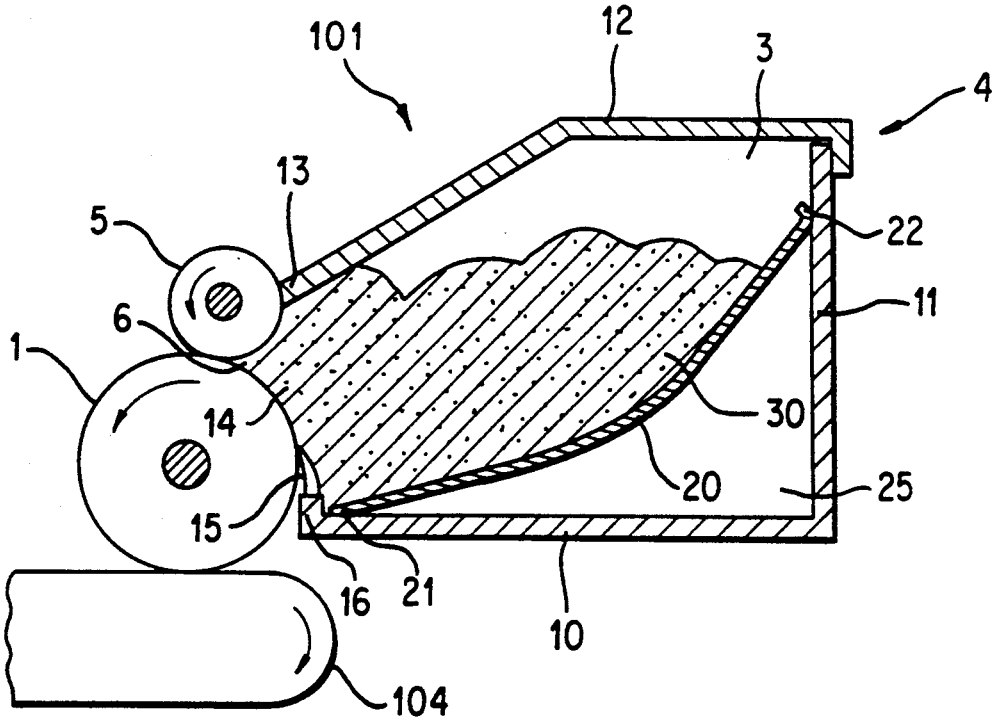
FIG. 4 is a schematic representation in cross section of the developer housing shown in FIG. 2 with a partially full developer sump.
Figure 5:
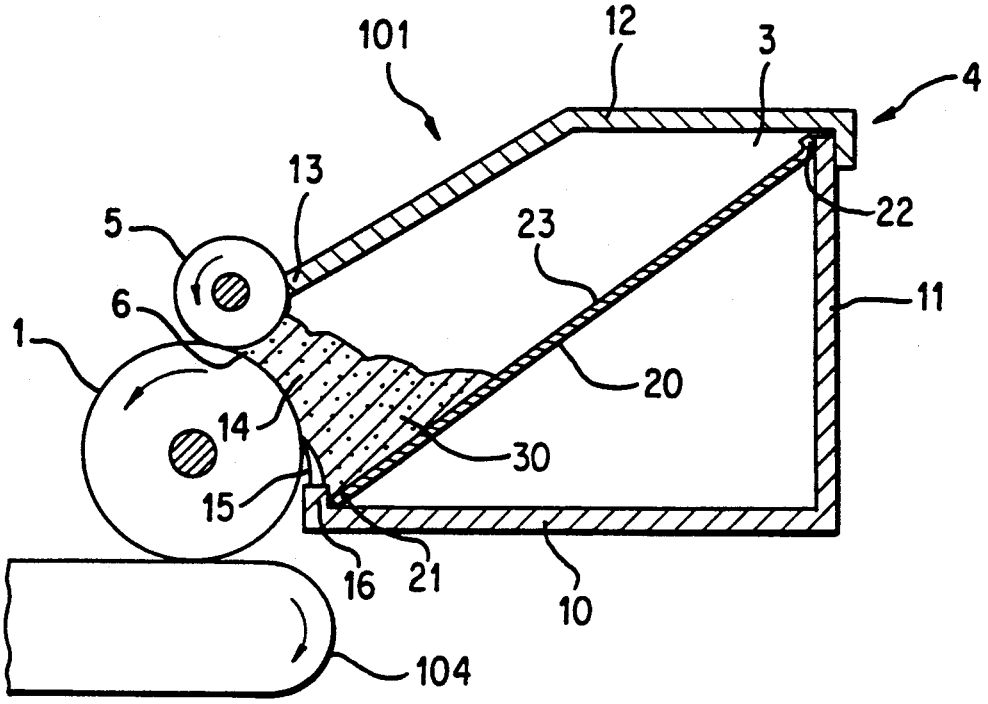
FIG. 5 is a schematic representation in cross section of the developer housing shown in FIG. 2 with a nearly empty developer sump.

The developer mover is dimensioned such that in its straight, unflexed position its length is slightly less that the diagonal dimension of the housing, as shown in FIG. 2. The developer mover thus divides the housing into a first, developer reservoir region 3 bounded by the second surface of the mover and the side wall and in fluid communication with the opening, and a second region 25 bounded by the first surface of the mover and the side wall. The aspect ratio of the mover, and the physical properties of its constituent material, are such that, as shown in FIG. 3, when developer particle supply reservoir 3 is full of developer 30, the weight of the developer deflects the mover so that it generally conforms to lower wall 10 and vertical wall 11. In this position, the volume of the second region 25 is near zero while the volume of the first, developer reservoir region 3 is nearly equal to the total internal volume of the housing.

Figure 6:
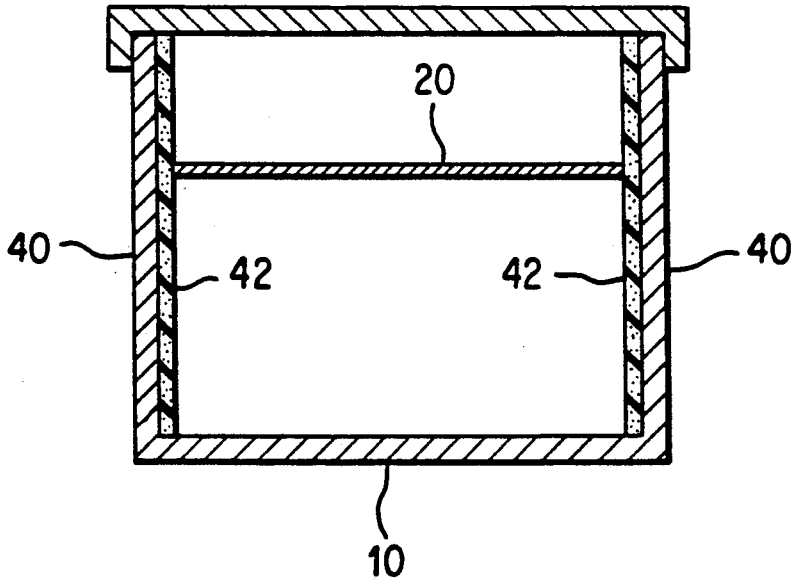
FIG. 6 is a cross section of the developer housing shown in FIG. 5.

As seen in FIG. 6, developer housing 4 is closed at its ends by parallel end walls 40, which can be fitted with compliant sealing sheets 42 that sealingly engage the sides of the developer mover 20 through its range of motion to prevent developer from leaking from the developer reservoir region 3 into the second region 25.

The operation of the reproducing machine illustrated in FIG. 1 and the developer station illustrated in FIGS. 2–5 are as follows.

Original document 129 is placed image side down on horizontal transport viewing platen 130. The platen transports the original document past exposure station 111 while photoreceptor belt 104 is driven by motor 107 via driver transport roll 106 in synchronization with the platen. Charging station 109 charges the belt uniformly with an electrostatic charge by placing the charge on the photoconductive surface with charge corotron 110. Exposure station 111 exposes the photoconductive surface 105 to the light image of the original document, selectively dissipating the uniform charge in the light exposed regions to record the original image in the form of an electrostatic latent image.

Developer station 101 applies developer to the photoconductive surface of the belt to render the latent image visible. Developer particles from developer reservoir region 3 are urged toward opening 14 by developer mover 20, where they are carried on the surface of donor roll 1 through nip 6 and between the donor roll and metering charging roll 5 as the rolls rotate, and acquire an electrostatic charge. These charged developer particles are then transported by the donor roll to the electrostatic latent image recorded on photoreceptor belt 104. The electrostatic latent image attracts the toner particles from donor roll 1 to form a powder image on the surface of photoreceptor belt 104. As developer is discharged from the developer particle supply reservoir 3 by the donor and metering charging rolls, the weight of the developer decreases and the developer mover straightens. When the developer is nearly depleted the developer mover approaches an unflexed condition, acting as a slide down which the remaining developer is drawn by gravity towards dispensing opening 14.

Sheets 115 of the final support material are fed from elevated stack support tray 116 by sheet separator segmented feed rolls 117 to the registration pinch roll pair 118. The pinch roll pair feeds the sheets to the transfer station 119, where the developer image is transferred from the photoreceptor belt 104 to the sheet by the transfer corotron 120. Fixing station 121 then fixes the transferred toner image to the sheet. Output rolls 123 advance finished sheets to sheet stacking tray 124. Finally, residual toner remaining on the photoreceptor belt 104 is removed at cleaning station 125.

While the invention has been described with reference to a specific embodiment, it will be apparent to those skilled in the art that many alternatives, modifications, and variations may be made. Accordingly, it is intended to embrace all such alternatives, modifications that may fall within the spirit and scope of the appended claims.

What is claimed is:

1. A developer dispenser comprising:

a. a substantially enclosed and rigid housing having a side wall with an opening therein, two end walls, and a compliant sealing surface attached to each of said end walls;

b. a flexible developer mover disposed within said housing, said developer mover having:

i. a first edge pivotably secured within said housing;

ii. a second edge in sliding contact with a first portion of said side wall;

iii. parallel edges connecting said first edge and said second edge, said parallel edges being in slidably sealing engagement with said compliant sealing surfaces;

iv. a first surface facing said first portion of said side wall; and v. a second surface for engaging the developer material, said developer mover dividing said housing into a first, developer reservoir region bounded by said second surface of said developer mover and said side wall and being in fluid communication with said opening and a second region bounded by said first surface and said side wall, said developer mover configured for assuming a first, unflexed position when said housing contains no developer material, for flexing about an axis parallel to said side wall, and for displacing said first surface to a second position when said housing is filled with developer in which said first surface conforms approximately to said first portion of said side wall and said second region has a volume much less than when said developer mover is in said first position, said developer mover urging the developer toward said opening, and flexing toward said first position as developer is dispensed through said opening.

2. The developer dispenser of claim 1 further comprising a coating of poly(ethylene terephthalate) applied to said second surface of said developer mover.

3. The developer dispenser of claim 2 wherein said second edge terminates in an arcuate portion curving about an axis parallel to said side wall and toward said second surface, said second edge slidably contacting said first portion of said side wall with said arcuate portion.

4. The developer dispenser of claim 3 wherein said developer mover is formed of spring steel.

5. The developer dispenser of claim 4 wherein said developer mover has an aspect ratio of between 4,000 and 2,667.

6. An electrostatographic developer dispenser comprising:

a. a substantially enclosed rigid housing, said housing having:

i. first and second generally planar, side walls, said first side wall being generally horizontal, having a laterally proximal end and a laterally distal end, said second side wall depending upwardly from said distal end of said first side wall;

ii. a third side wall having a distal end and a proximal end, said distal end being attached to the upper end of said second side wall;

iii. end walls connecting said side walls; and iv. an opening therein, said opening being bounded by said end walls and said distal ends of said first and third side walls; and b. a resilient developer mover disposed within said housing, said developer mover having:

i. a first edge pivotably connected to said proximal end of said first side wall;

ii. a second edge in sliding contact with said second side wall;

iii. parallel edges connecting said first edge and said second edge, said parallel edges being in slidably sealing engagement with said end walls;

iv. a first surface generally facing said first and second side walls; and v. a second surface generally facing said opening, said developer mover configured for flexing about an axis parallel to said side walls between a first, generally L-shaped position in which said first surface contacts said first and second side walls when said housing is filled with developer material and a second, generally planar, unflexed position when said housing contains no developer material, and urging the developer toward said opening.

7. The electrostatographic developer dispenser of claim 6 further comprising a compliant sealing surface attached to each of said end walls, said sealing surface providing said slidably sealing engagement between said parallel edges and said end walls.

8. The electrostatographic developer dispenser of claim 7 further comprising a coating of poly(ethylene terephthalate) applied to said second surface of said developer mover.

9. The electrostatographic developer dispenser of claim 8 wherein said second edge terminates in an arcuate portion curving about an axis parallel to said side walls and toward from said second surface, said second edge slidably contacting said second side wall with said arcuate portion.

10. The electrostatographic developer dispenser of claim 9 wherein said developer mover is formed of stainless spring steel.

11. The developer dispenser of claim 10 wherein said developer mover has an aspect ratio of between 4,000 and 2,667.

12. An electrostatographic developer dispenser comprising:

a. a substantially enclosed rigid housing, said housing having:

i. first and second generally planar, side walls, said first side wall being generally horizontal, having a laterally proximal end and a laterally distal end, a shoulder portion depending upwardly from said proximal end of said first side wall and said second side wall depending upwardly from said distal end of said first side wall and having an upper end;

ii. a third side wall having a distal end and a proximal end, said distal end being attached to said upper end of said second side wall;

iii. end walls connecting said side walls, each of said end walls having a compliant sealing surface formed thereon; and iv. an opening therein, said opening being bounded by said end walls, said distal end of said third side wall, and said shoulder of said first side wall; and b. a resilient developer mover formed of stainless spring steel, having an aspect ratio between 4,000 and 2,667, and being disposed within said housing, said developer mover having:

i. a first edge abutting said shoulder of said first side wall;

ii. a second edge terminating in an arcuate portion curving about an axis parallel to said side walls and away from said second side wall, said second edge slidably contacting said second side wall with said arcuate portion;

iii. parallel edges connecting said first edge and said second edge, said parallel edges being in slidably sealing engagement with said compliant sealing surfaces of said end walls;

iv. a first surface generally facing said first and second side walls; and v. a second surface generally facing said opening and having a coating of poly(ethylene terephthalate) applied thereto, said developer mover flexing about an axis parallel to said side walls between a first, generally L-shaped position in which said first surface contacts said first and second side walls when said housing is filled with developer material and a second, generally planar, unflexed position when said housing contains no developer material, and urging the developer toward said opening.

* * * * *